US009018844B2

(12) United States Patent
Lin

(10) Patent No.: US 9,018,844 B2
(45) Date of Patent: Apr. 28, 2015

(54) CONTROLLERS AND LIGHT MODULES WITH LIGHT EMITTING DIODES

(71) Applicant: Shamrock Micro Devices Corp., Taipei (TW)

(72) Inventor: Chien-Liang Lin, Keelung (TW)

(73) Assignee: Shamrock Micro Devices Corp., Taipei (TW)

( * ) Notice: Subject to any disclaimer, the term of this patent is extended or adjusted under 35 U.S.C. 154(b) by 402 days.

(21) Appl. No.: 13/633,427

(22) Filed: Oct. 2, 2012

(65) Prior Publication Data

US 2013/0334975 A1 Dec. 19, 2013

(30) Foreign Application Priority Data

Jun. 14, 2012 (TW) ..... 101121232 A

(51) Int. Cl.
*H05B 37/00* (2006.01)
*H05B 33/08* (2006.01)

(52) U.S. Cl.
CPC ..... *H05B 33/083* (2013.01)

(58) Field of Classification Search
CPC ..... H05B 33/0815; H05B 37/02; H05B 33/0824; H05B 33/08; H05B 33/0842; H05B 33/0812; H05B 37/00; H05B 41/04; H05B 41/36; Y02B 20/347; Y02B 20/346; F21Y 2103/003; F21V 23/04
USPC ..... 315/127, 128, 193, 226, 224, 291, 295, 315/297, 299, 300, 301, 302, 306, 307, 312, 315/313, 362
See application file for complete search history.

(56) References Cited

U.S. PATENT DOCUMENTS

| | | | | |
|---|---|---|---|---|
| 8,488,353 | B2 * | 7/2013 | Ribarich | 363/98 |
| 2004/0113570 | A1 * | 6/2004 | Ribarich et al. | 315/307 |
| 2010/0072902 | A1 * | 3/2010 | Wendt et al. | 315/161 |

* cited by examiner

*Primary Examiner* — Douglas W Owens
*Assistant Examiner* — Jianzi Chen
(74) *Attorney, Agent, or Firm* — McClure, Qualey & Rodack, LLP

(57) ABSTRACT

Disclosed are a controller and a relevant LED lighting module. A disclosed controller comprises a high-voltage power terminal and a low-voltage power terminal, a major switch circuit, an upward-connection terminal and a downward-connection terminal, and a management circuit. The major switch circuit is coupled between the high-voltage and low-voltage power terminals, and has a driving terminal for coupling to at least one LED. The management circuit is coupled to control the major switch circuit, and configured to communicate with an upstream controller via the upward-connection terminal and to communicate with a downstream controller via the downward-connection terminal. The upward-connection terminal is coupled to the downward-connection terminal of an upstream controller. The downward-connection terminal is coupled to the upward-connection terminal of a downstream controller. The management circuit is capable of operating in one of operation conditions.

18 Claims, 4 Drawing Sheets

CONTROLLERS AND LIGHT MODULES WITH LIGHT EMITTING DIODES

CROSS-REFERENCE TO RELATED APPLICATION

This application claims priority to and the benefit of Taiwan Application Series Number 101121232 filed on Jun. 14, 2012, which is incorporated by reference in its entirety.

BACKGROUND

The present disclosure relates generally to controllers and light modules with light emitting diodes (LEDs), and more particularly to controllers and LED modules capable of achieving high power factor and efficiency.

As well known in the art, there are different kinds of lighting fixtures developed in addition to the familiar incandescent light bulb, such as halogen lights, florescent lights and LED (light emitting diode) lights. LED lighting fixtures have several advantages. For example, LEDs have been developed to have lifespan up to 50,000 hours, about 50 times as long as a 60-watt incandescent bulb. This long lifespan makes LED lighting fixtures suitable in places where changing bulbs is difficult or expensive (e.g., hard-to-reach places, such as the exterior of buildings). Furthermore, a LED requires minute amount of electricity, having luminous efficacy about 10 times higher than an incandescent bulb and 2 times higher than a florescent light. Power consumption and conversion efficiency are big concerns in the art, and it has been a trend for LED lighting fixtures to replace several kinds of lighting fixtures.

There are several obstacles for LED lights to replace other kinds of lights, however. For example, ENERGY STAR, a joint program of the U.S. Environmental Protection Agency and the U.S. Department of Energy, requires LED light to have a power factor no less than 0.7. Furthermore, LED lighting fixtures must be cheap enough to create motivation and affordability for consumers to such replacement.

Conventional LED drivers in LED lighting fixtures first rectify an alternative-current grid power source into a direct-current power source, which is then converted into another direct-current power source with a voltage specifically suitable to drive LEDs. Each of the conventional LED drivers, as known in the art, typically needs a costly inductive device (e.g., an inductor or a transformer) and an output electrolytic capacitor (for smoothing the output voltage). Electrolytic capacitors and LEDs deteriorate greatly, however, in a hot environment. Thus, LED lighting fixtures are inevitably equipped with complex and costly heat sinkers to cool the LEDs and the electrolytic capacitors therein. That's the reason why the LED lighting fixtures with conventional LED drivers have become luxuries which will cost consumers a lot.

SUMMARY

Embodiments of the invention disclose a controller adaptive for a light emitting diode module. The controller comprises a high-voltage power terminal and a low-voltage power terminal, a major switch circuit, an upward-connection terminal and a downward-connection terminal, and a management circuit. The major switch circuit is coupled between the high-voltage and low-voltage power terminals, and has a driving terminal for coupling to at least one LED. The management circuit is coupled to control the major switch circuit, and configured to communicate with an upstream controller via the upward-connection terminal and to communicate with a downstream controller via the downward-connection terminal. The upward-connection terminal is coupled to the downward-connection terminal of an upstream controller. The downward-connection terminal is coupled to the upward-connection terminal of a downstream controller. The management circuit is capable of operating in one of operation conditions.

Embodiments of the invention further disclose a lighting module with lighting apparatuses. The lighting apparatuses forms a string coupled between a line power and a ground line. Each lighting apparatus comprise at least one LED and a controller. The controller comprises a high-voltage power terminal and a low-voltage power terminal, a major switch circuit, an upward-connection terminal and a downward-connection terminal, and a management circuit. The major switch circuit is coupled between the high-voltage and low-voltage power terminals, and has a driving terminal for coupling to at least one LED. The management circuit is coupled to control the major switch circuit, and configured to communicate with an upstream controller via the upward-connection terminal and to communicate with a downstream controller via the downward-connection terminal. The upward-connection terminal is coupled to the downward-connection terminal of an upstream controller. The downward-connection terminal is coupled to the upward-connection terminal of a downstream controller. The management circuit is capable of operating in one of operation conditions.

BRIEF DESCRIPTION OF THE DRAWINGS

The invention can be more fully understood by the subsequent detailed description and examples with references made to the accompanying drawings, wherein.

DETAILED DESCRIPTION

Figure 1:
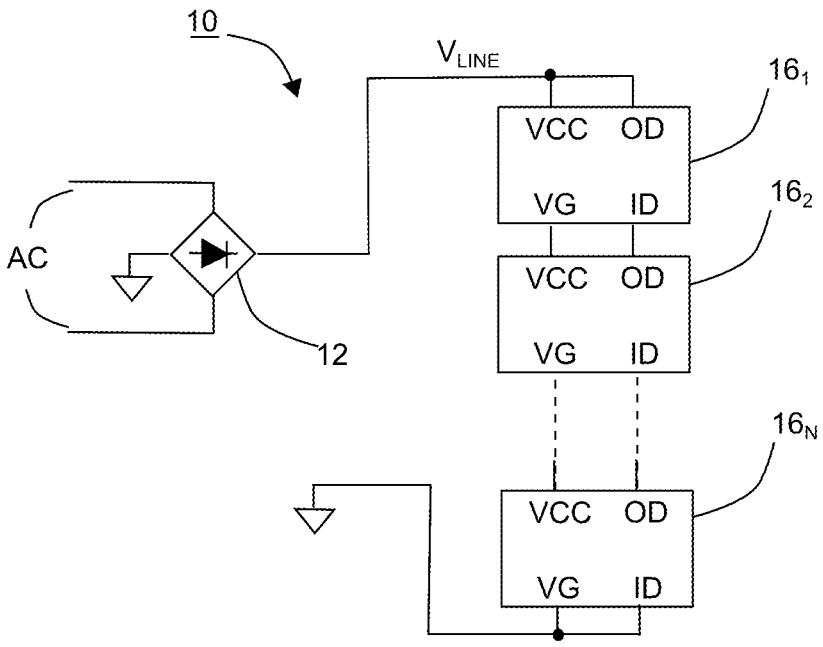
FIG. 1 illustrates a light module according to an embodiment of the invention.

FIG. 1 illustrates a light module 10 according to an embodiment of the invention. The light module 10 has a bridge rectifier 12 to rectify the AC grid power into a direct current (DC) line power $V_{LINE}$ and a ground line, where the voltage of line power $V_{LINE}$ is higher than the ground line and its voltage value could vary along with the voltage of the AC grid power. Connected in series are N lighting apparatuses $\mathbf{16}_1 \ldots \mathbf{16}_N$, forming a string, where N is a positive integer. In view of the voltage at the high-voltage power terminal VCC of an individual lighting apparatus, lighting apparatus $\mathbf{16}_{n+1}$ is a downstream one relatively to lighting apparatus $\mathbf{16}_n$, which in the opposite is an upstream one relatively to lighting apparatus $\mathbf{16}_{n+1}$, as current flows from the line power $V_{LINE}$ to the ground line.

As shown in FIG. 1, each lighting apparatus $\mathbf{16}_n$ has four terminals, including high-voltage power terminal VCC, low-voltage power terminal VG, upward-connection terminal OD and downward-connection terminal ID. Most of the operation current required for the lighting apparatus $\mathbf{16}_n$ comes from the high-voltage power terminal VCC and the low-voltage power terminal VG. The high-voltage power terminal VCC of lighting apparatus $\mathbf{16}_n$ is connected to the low-voltage power terminal VG of the upstream lighting apparatus $\mathbf{16}_{n-1}$, and the low-voltage power terminal VG of lighting apparatus $\mathbf{16}_n$ is connected to the high-voltage power terminal VCC of the downstream lighting apparatus $\mathbf{16}_{n+1}$. Similarly, the upward-connection terminal OD and the downward-connection terminal ID are connected to the downward-connection terminal ID of the upstream lighting apparatus $\mathbf{16}_{n-1}$ and the upward-connection terminal OD of the downstream lighting apparatus $\mathbf{16}_{n+1}$, respectively. The most upstream lighting apparatus $\mathbf{16}_1$ has its high-voltage power terminal VCC and upward-connection terminal OD both coupled to line power $V_{LINE}$. The most downstream lighting apparatus $\mathbf{16}_N$ has its low-voltage power terminal VG and downward-connection terminal ID both coupled to the ground line.

Figure 2:
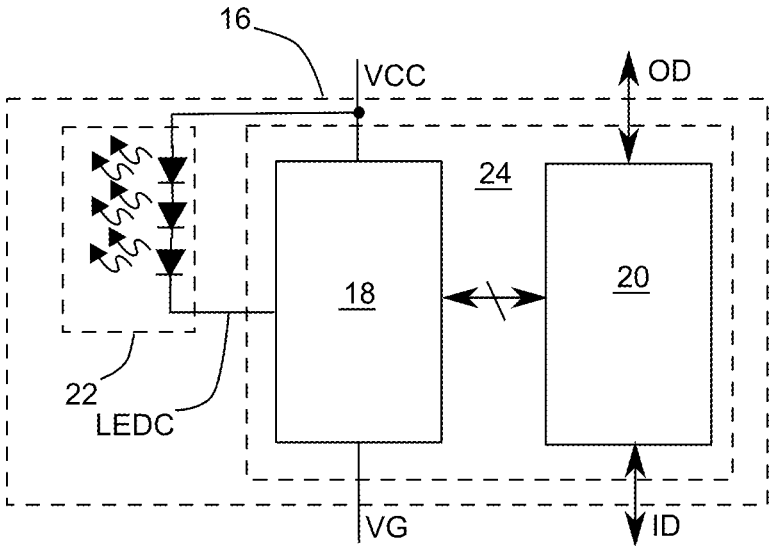
FIG. 2 demonstrates a lighting apparatus, which could be any one of the lighting apparatuses in FIG. 1.

FIG. 2 demonstrates a lighting apparatus 16, which could be any one of the lighting apparatuses $\mathbf{16}_1 \ldots \mathbf{16}_N$. The lighting apparatus 16 has light emitting diodes (LEDs) 22 and a controller 24 with four terminals respectively representing the high-voltage power terminal VCC, the low-voltage power terminal VG, the upward-connection terminal OD, and the downward-connection terminal ID of the lighting apparatus 16. The controller 24 further has a driving terminal LEDC. LEDs 22, acting together as a light source, are connected in series between the high-voltage power terminal VCC and the driving terminal LEDC. In one embodiment, the controller 24 is implemented by a monolithic integrated circuit with 5 pins: VCC, VG, OD, ID and LEDC. The invention, however, is not limited to, and the controller 24 might have pins more than 5. In one embodiment, all the lighting apparatuses $\mathbf{16}_1 \ldots \mathbf{16}_N$ in FIG. 1 are identical. In another embodiment, they might be different from each. For example, one might have LEDs 22 more than another does.

The controller 24 has a major switch circuit 18 and a management circuit 20. The major switch circuit 18, coupled between the high-voltage power terminal VCC and the lower-voltage power terminal VG, controls the current passing through the driving terminal LEDC and LEDs 22. The management circuit 20 communicates with an upstream lighting apparatus via the upward-connection terminal OD, and with a downstream lighting apparatus via the downward-connection ID. The management circuit 20 includes some registers or memories to record what operation condition the controller 24 is operating in.

Figure 3A:
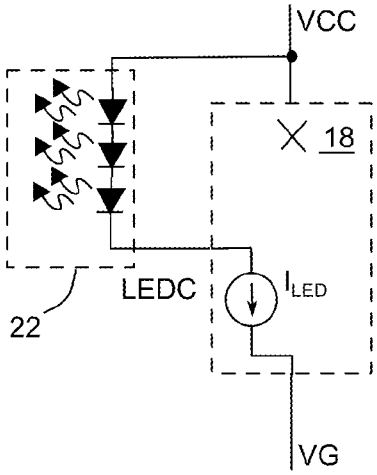
FIGS. 3A and 3B show the behaviors of a major switch circuit when operating in the open and short conditions, respectively.
Figure 3B:
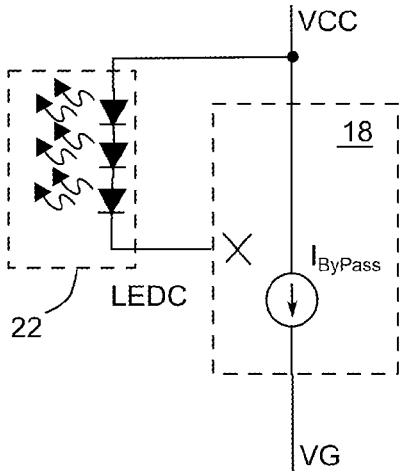

In one embodiment, the operation conditions for the controller 24 include an open condition and a short condition. FIGS. 3A and 3B show the behaviors of the major switch circuit 18 when operating in the open and short conditions, respectively. As shown in FIG. 3A, when operating in the open condition, the management circuit 20 controls the major switch circuit 18 to provide constant driving current $I_{LED}$ draining from the driving terminal LEDC and going to the low-voltage power terminal VG. Constant driving current $I_{LED}$, from a constant current source, also flows through LEDs 22 to light it up. In the meantime, the major switch circuit 18 performs high input impedance at the high-voltage power terminal VCC, such that little or no current flows from the high-voltage power terminal VCC into the major switch circuit 18. As shown in FIG. 3B, when operating in the short condition, the management circuit 20 controls the major switch circuit 18 to provide constant bypass current $I_{ByPass}$ flowing between the high-voltage power terminal VCC and the low-voltage power terminal VG. Meanwhile, the driving terminal LEDC performs high input impedance, such that LEDs 22 are dark because little or no current passes through. The constant driving current $I_{LED}$ and the constant bypass current $I_{ByPass}$ could, but are not limited to, have the same value. It is up to designer's choice to determine the magnitudes of the constant currents $I_{LED}$ and $I_{ByPass}$. In conclusion, the LEDs in a lighting apparatus shine if the controller of the lighting apparatus operates in the open condition, but are dark if it operates in the short condition.

Figure 4:
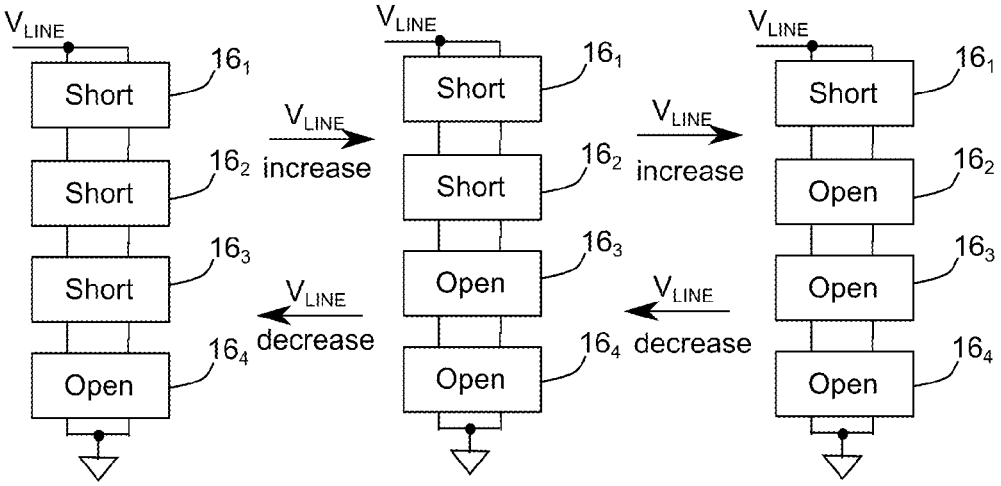
FIG. 4 shows the change of operation condition of each lighting apparatus when line power $V_{LINE}$ varies.

FIG. 4 shows the change of operation condition of each lighting apparatus when line power $V_{LINE}$ varies, where a string with 4 lighting apparatuses (symbolized as $\mathbf{16}_1$ to $\mathbf{16}_4$) is taken as an example. In FIG. 4, the controller of a lighting apparatus operates in the open condition if the lighting apparatus is marked as "Open", and in the short condition if the lighting apparatus is marked as "Short". It is supposed that the string in the middle portion of FIG. 4 has lighting apparatuses $\mathbf{16}_1$, $\mathbf{16}_2$, $\mathbf{16}_3$ and $\mathbf{16}_4$, whose controllers are operating in the short, short, open and open conditions respectively, when line power $V_{LINE}$ has a certain voltage. If the line power $V_{LINE}$ in the middle portion of FIG. 4 decreases to a certain amount, the communication between lighting apparatuses $\mathbf{16}_2$ and $\mathbf{16}_3$ renders the lighting apparatus $\mathbf{16}_3$ turning to the short condition, as illustrated in the left portion of FIG. 4. Accordingly, there in the string the lighting apparatus $\mathbf{16}_4$ alone operates in the open condition, shining. If the line power $V_{LINE}$ in the middle portion of FIG. 4 increases to a certain amount, the communication between lighting apparatuses $\mathbf{16}_2$ and $\mathbf{16}_3$ renders the lighting apparatus $\mathbf{16}_2$ turning to the open condition, as illustrated in the right portion of FIG. 4. Accordingly, the lighting apparatuses $\mathbf{16}_2$, $\mathbf{16}_3$ and $\mathbf{16}_4$ shine but the lighting apparatus $\mathbf{16}_1$ does not. How the lighting apparatuses communicate with each other will be detailed later.

As exemplified in FIG. 4, it can be found that when the line power $V_{LINE}$ starts to increase from zero the most downstream lighting apparatus has the first priority to shine. As the line power $V_{LINE}$ increases more, the most downstream, non-shining lighting apparatus will join to shine, one by one. The most upstream lighting apparatus has the last priority to shine. As a result, the higher the line power $V_{LINE}$, the more the number of the lighting apparatuses operating in the open condition, shining. This kind of behavior could increase both lighting efficiency and power factor of the light module 10. Another benefit derivable from FIG. 1 is that light module 10 needs no power converters or transformers. The total cost of light module 10 could be very low or attractive to manufactures and consumers.

Figure 5:
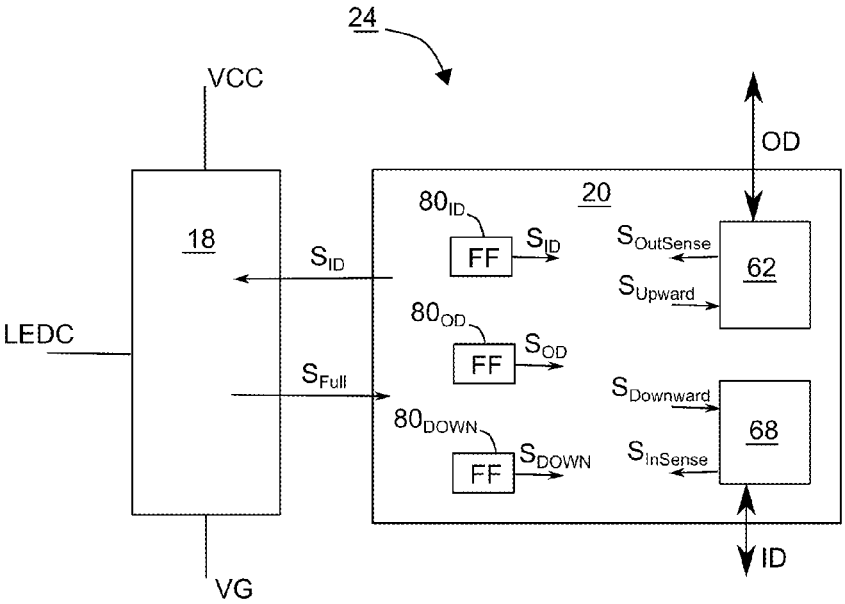
FIG. 5 shows some signals and devices in the controller of FIG. 2.

FIG. 5 shows some signals and devices in the controller 24. The management circuit 20 has up-link circuit 62, down-link circuit 68, and memories $\mathbf{80}_{ID}$, $\mathbf{80}_{OD}$ and $\mathbf{80}_{DOWN}$. Memories $\mathbf{80}_{ID}$, $\mathbf{80}_{OD}$ and $\mathbf{80}_{DOWN}$ could be, but not be limited to, flip-flops or registers. They provide signals $S_{ID}$, $S_{OD}$ and $S_{DOWN}$, whose logic levels represent whether the major switch circuit 18 operates in an open condition or a short condition, whether to activate the up-link circuit 62, and whether to activate a down-link circuit 68, respectively. The major switch circuit 18 receives signal $S_{ID}$ to accordingly operate in the open condition shown in FIG. 3A or in the short condition shown in FIG. 3B. The major switch circuit 18 responses to provide signal $S_{Full}$ to notify the management circuit 20 whether the power provided from both the high-voltage power terminal VCC and the low-voltage power terminal VG is enough for driving LEDs.

Figure 6:
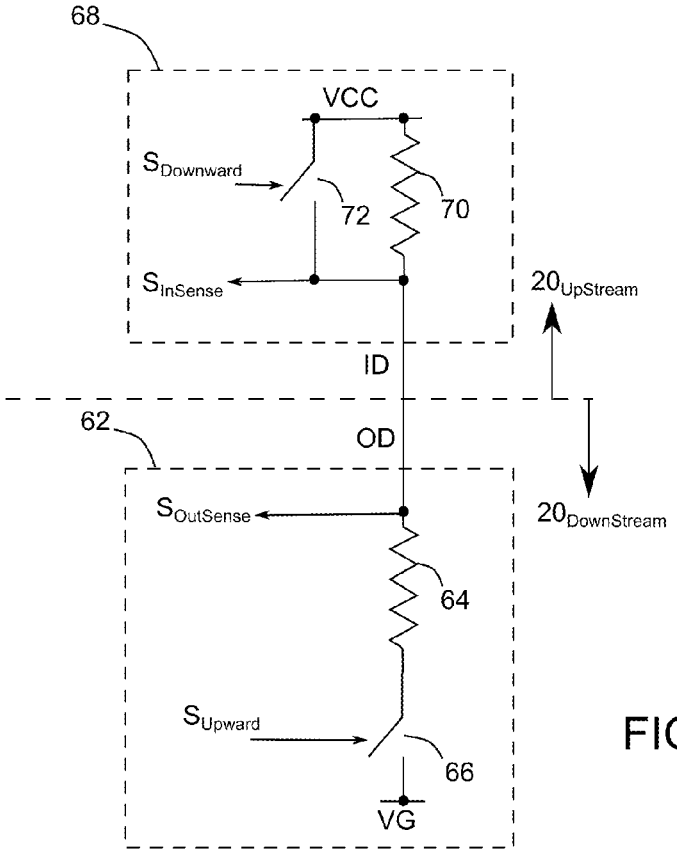
FIG. 6 demonstrates an up-link circuit in a downstream management circuit and a down-link circuit in an upstream management circuit.

Via upward-connection terminal OD, the management circuit 20 communicates with another management circuit in the controller of an upstream lighting apparatus. FIG. 6 demonstrates an up-link circuit 62 in a downstream management circuit $\mathbf{20}_{DownStream}$ and a down-link circuit 68 in an upstream management circuit $\mathbf{20}_{UpStream}$. The up-link circuit 62 has a switch 66 and a resistor 64 coupled in series between the upward-connection terminal OD and the low-voltage power terminal VG (of the downstream management circuit $\mathbf{20}_{DownStream}$). The down-link circuit 68 has a resistor 70 and a switch 72 coupled in parallel between the high-connection terminal ID and the high-voltage power terminal VCC (of the upstream management circuit $\mathbf{20}_{UpStream}$). When the up-link circuit 62 is activated, the switch 66 is turned ON, performing a short circuit, and the voltage level of the signal $S_{OutSense}$ could act as an indicator for the downstream management circuit $\mathbf{20}_{DownStream}$ to differentiate whether the switch 72 in the upstream management circuit $\mathbf{20}_{UpStream}$ is open or short. Similarly, when the down-link circuit 68 is activated, the switch 72 is turned Off, performing an open circuit, and the voltage level of the signal $S_{InSense}$ could inform the upstream management circuit $\mathbf{20}_{UpStream}$ whether the switch 66 in the downstream management circuit $\mathbf{20}_{DownStream}$ is open or short. Accordingly, the downstream management circuit $\mathbf{20}_{DownStream}$ and the upstream management circuit $\mathbf{20}_{UpStream}$ are capable of bidirectional communication to transfer information therebetween.

Figure 7:
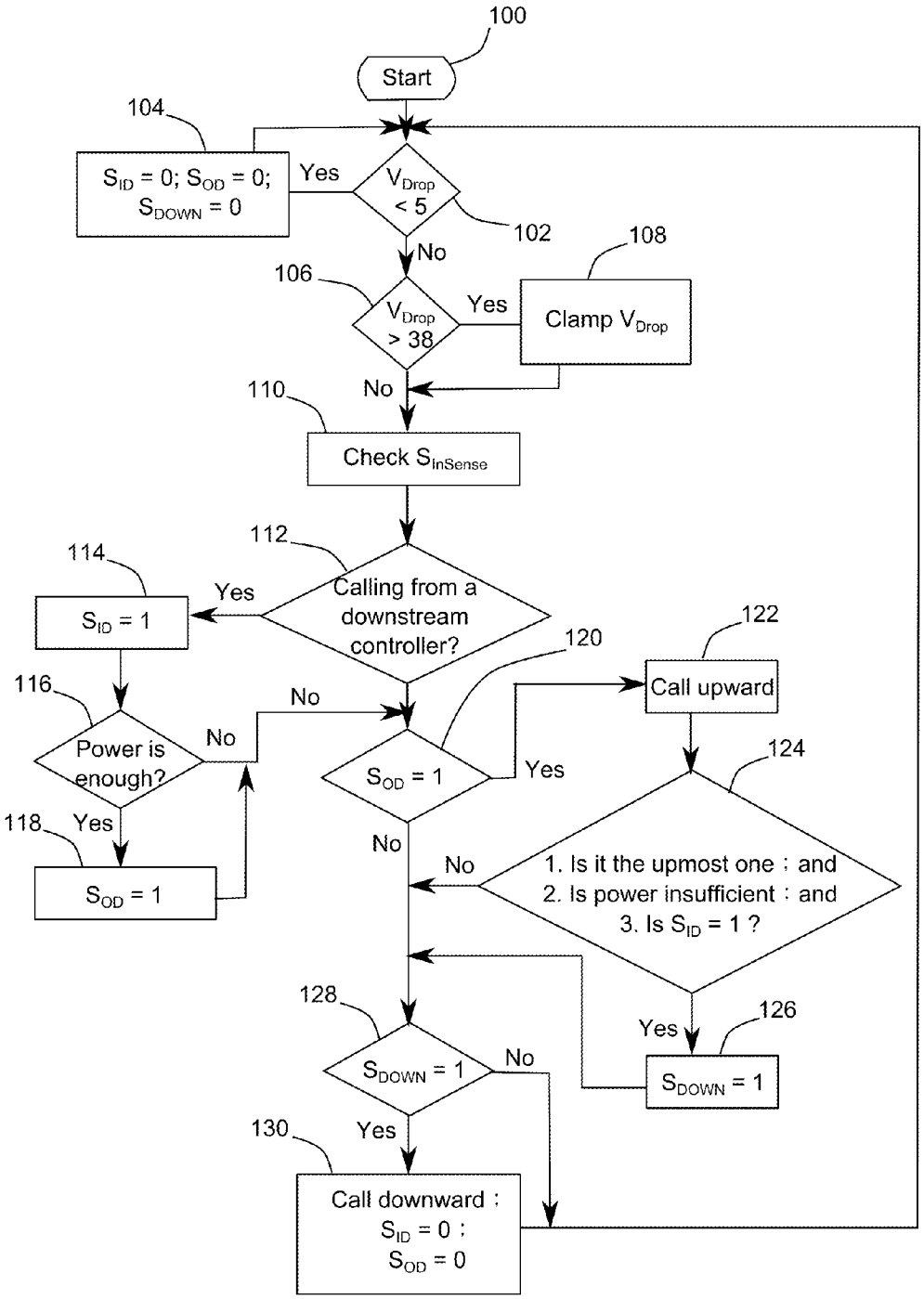
FIG. 7 shows a control method used in the controller of FIG. 2.

FIG. 7 shows a control method used in the controller 24. Please as well refer to both FIGS. 5 and 6. The control method starts from step 100. Step 102 follows to check whether the operation voltage $V_{Drop}$ across the high-voltage power terminal VCC and the low-voltage power terminal VG is high enough for the controller 24 to operate properly. In this embodiment, step 102 checks if the operation voltage $V_{Drop}$ is less than 5 volt. If so, step 104 resets memories $\mathbf{80}_{ID}$, $\mathbf{80}_{OD}$ and $\mathbf{80}_{DOWN}$, making signals $S_{ID}$, $S_{OD}$ and $S_{DOWN}$ all to be 0 in logic. If the operation voltage $V_{Drop}$ is not too low, step 106 follows to check whether it is too high (i.e. over 38 volts as shown in FIG. 7). In case that the operation voltage $V_{Drop}$ exceeds 38V, the controller 24 clamps the operation voltage $V_{Drop}$, making it no higher than a safe upper limit voltage to avoid overstress damage. If the operation voltage $V_{Drop}$ is appropriate (i.e. between 38V and 5V in FIG. 7), step 110 checks signal $S_{InSense}$. If the logic level of signal $S_{InSense}$ indicates the switch 66 in an up-link circuit of a downstream controller is turned ON (in step 112), performing a short circuit, it implies the downstream controller is calling the controller 24, and step 114 follows. In step 114, memory $\mathbf{80}_{ID}$ is set, and signal $S_{ID}$ becomes 1 in logic, such that the controller 24 operates in the open condition and the LEDs 22 (connected to the controller 24) shine. In step 116, based on the logic level of signal $S_{Full}$, whether the operation voltage $V_{Drop}$ has enough power to light on the LEDs in an upstream lighting apparatus is determined. If the power is enough (the Yes route from step 116), step 118 sets signal $S_{OD}$ to be 1 in logic, preparing to call upward.

Step 120 checks the logic value of signal $S_{OD}$. If it is 1 in logic, step 122, via signal $S_{Upward}$, makes the switch 66 a short circuit to call the controller in an upstream lighting apparatus. Step 124 checks 3 things. The first one is whether the controller 24 is inside the most upstream one among those lighting apparatuses operating in the open condition. This can be known by checking the voltage level of signal $S_{OutSense}$, which indicates whether an upstream controller is calling the controller 24. The second one is whether the power provided by the operation voltage $V_{Drop}$ drops, becoming too low, and this is indicated by signal $S_{Full}$. The third one is whether signal $S_{ID}$ is 1 in logic, meaning the major switch circuit 18 of the controller 24 operates in the open condition. Only when these three things are all positive, step 126 sets signal $S_{DOWN}$ to be 1 in logic. Otherwise, step 128 follows.

Step 128 checks the logic level of signal $S_{DOWN}$. If signal $S_{DOWN}$ is 1 in logic, step 130 turns both signals $S_{ID}$ and $S_{OD}$ into 0 in logic. Via signal $S_{Downward}$, step 130 also makes the switch 72 a short circuit, to call a downstream controller. Step 102 follows step 130 or step 128, to recheck the operation voltage $V_{Drop}$.

It was verified by circuit simulation that the operation condition change in FIG. 4 is achievable. Accordingly, the embodiment of the invention could improve the lighting efficiency, the power factor, and manufacture cost of an end product.

In FIG. 6, the switches 66 and 72 are turned on or off to provide a means for bidirectional communication between two controllers. This invention is not, however, limited to. Persons skilled in the art can derive other kinds of bidirectional communication means for two controllers based on the aforementioned teaching without departing away from the invention.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A controller adaptive for a light emitting diode module, comprising:

a high-voltage power terminal and a low-voltage power terminal;

a major switch circuit, coupled between the high-voltage and low-voltage power terminals, having a driving terminal for coupling to at least one LED;

an upward-connection terminal and a downward-connection terminal; and a management circuit, coupled to control the major switch circuit, and configured to communicate with an upstream controller via the upward-connection terminal and to communicate with a downstream controller via the downward-connection terminal;

wherein the upward-connection terminal is coupled to the downward-connection terminal of an upstream controller;

the downward-connection terminal is coupled to the upward-connection terminal of a downstream controller; and the management circuit is capable of operating in one of operation conditions.

2. The controller as claimed in claim 1, wherein the operation conditions include an open condition when a driving current passing and lighting up the LED is about a predetermined value.

3. The controller as claimed in claim 1, wherein the operation conditions include a short condition when a driving current passing through the LED is about zero and a bypass current passing through the major switch circuit is about a predetermined value.

4. The controller as claimed in claim 1, wherein the major switch circuit includes a constant current source, coupled in series with the LED between the high-voltage power terminal and the low-voltage power terminal.

5. The controller as claimed in claim 1, wherein the major switch circuit notifies the management circuit whether the power provided from both the high-voltage power terminal and the low-voltage power terminal is enough.

6. The controller as claimed in claim 1, wherein the management circuit includes at least one memory to memorize a present operation condition.

7. The controller as claimed in claim 1, wherein the management circuit further comprises:

an up-link circuit and a down-link circuit;

wherein the up-link circuit is configured to communicate with a down-link circuit in the upstream controller; and the down-link circuit is configured to communicate with an up-link circuit in the downstream controller.

8. The controller as claimed in claim 7, wherein one of the up-link and down-link circuits has a first resistor and a first switch connected in parallel, and the other has a second resistor and a second switch connected in series.

9. A light module, comprising:

lighting apparatuses, forming a string coupled between a line power and a ground line, each lighting apparatus comprising:

at least one lighting emitting diode; and a controller, comprising:

a high-voltage power terminal and a low-voltage power terminal;

a major switch circuit, coupled between the high-voltage and low-voltage power terminals, having a driving terminal for coupling to at least one LED;

an upward-connection terminal and a downward-connection terminal; and a management circuit, coupled to control the major switch circuit, and configured to communicate with an upstream controller via the upward-connection terminal and to communicate with a downstream controller via the downward-connection terminal;

wherein the upward-connection terminal is coupled to the downward-connection terminal of an upstream controller;

the downward-connection terminal is coupled to the upward-connection terminal of a downstream controller; and the management circuit is capable of operating in one of operation conditions.

10. The light module as claimed in claim 9, wherein the operation conditions include an open condition when a driving current passing and lighting up the LED is about a predetermined value.

11. The light module as claimed in claim 9, wherein the operation conditions include a short condition when a driving current passing through the LED is about zero and a bypass current passing through the major switch circuit is about a predetermined value.

12. The light module as claimed in claim 9, wherein when the voltage drop across the line power and the ground line increases, the lighting apparatuses light up one by one according to a predetermined priority sequence.

13. The light module as claimed in claim 9, wherein the most downstream lighting apparatus among the lighting apparatuses has the first priority to shine.

14. The light module as claimed in claim 9, wherein the most upstream lighting apparatus among the lighting apparatuses has the last priority to shine.

15. The light module as claimed in claim 9, wherein the management circuit further comprises:

an up-link circuit and a down-link circuit;

wherein the up-link circuit is configured to communicate with a down-link circuit in the upstream controller; and the down-link circuit is configured to communicate with an up-link circuit in the downstream controller.

16. The light module as claimed in claim 9, wherein the major switch circuit notifies the management circuit whether the power provided from both the high-voltage power terminal and the low-voltage power terminal is enough.

17. The light module as claimed in claim 16, wherein one of the up-link and down-link circuits has a first resistor and a first switch connected in parallel, and the other has a second resistor and a second switch connected in series.

18. The light module as claimed in claim 9, wherein the major switch circuit includes a constant current source, coupled in series with the LED between the high-voltage power terminal and the low-voltage power terminal.

* * * * *